US007379045B2

(12) United States Patent
Morita

(10) Patent No.: US 7,379,045 B2
(45) Date of Patent: May 27, 2008

(54) LINE DRIVE CIRCUIT, ELECTRO-OPTIC DEVICE, AND DISPLAY DEVICE

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 499 days.

(21) Appl. No.: 10/170,967

(22) Filed: Jun. 13, 2002

(65) Prior Publication Data

US 2003/0011556 A1 Jan. 16, 2003

(30) Foreign Application Priority Data

Jun. 15, 2001 (JP) ..... 2001-181678

(51) Int. Cl.
*G09G 3/36* (2006.01)

(52) U.S. Cl. ..... 345/98; 345/100; 345/211; 345/212

(58) Field of Classification Search ..... 345/98, 345/100, 211, 212
See application file for complete search history.

(56) References Cited

U.S. PATENT DOCUMENTS

| | | | | |
|---|---|---|---|---|
| 5,745,092 | A * | 4/1998 | Ito | 345/95 |
| 6,181,313 | B1 * | 1/2001 | Yokota et al. | 345/100 |
| 2006/0226875 | A1 | 10/2006 | Shimaya | |

FOREIGN PATENT DOCUMENTS

| | | |
|---|---|---|
| JP | 6-167940 | 6/1994 |
| JP | 08-21984 | 1/1996 |
| JP | 9-6294 | 1/1997 |
| JP | 10-62746 | 3/1998 |
| JP | 10-96958 | 4/1998 |
| JP | 11-85090 | 3/1999 |
| JP | 2000-98954 | 4/2000 |
| JP | 2000-134047 | 5/2000 |
| JP | 2001-24502 | 1/2001 |
| JP | 2001-75071 | 3/2001 |
| JP | 2001-85989 | 3/2001 |
| JP | 2001-134237 | 5/2001 |
| JP | 2001-166726 | 6/2001 |
| JP | 2002-287111 | 10/2002 |

* cited by examiner

*Primary Examiner*—Sumati Lefkowitz
*Assistant Examiner*—Tammy Pham
(74) *Attorney, Agent, or Firm*—Rosalio Haro

(57) ABSTRACT

A line driver circuit, an electro-optic device, and a display apparatus efficiently reduce cost by reducing process dimensions and effectively shorten display panel development turn-around time by simplifying the reconfiguration of output voltages. The liquid crystal apparatus 10 has an LCD panel 20, a signal driver 30, a scan driver 50, and a power supply circuit 80, each of which is controlled by an LCD controller 60. Signal driver 30 contains an interface unit 200 for converting a first voltage specified for a low voltage process to a second voltage specified for a high voltage process. The interface circuitry within interface unit 200 is made up devices using a medium voltage process. Interface unit 200 receives and converts low voltage signals (i.e. first voltage level) supplied from LCD controller 60 to high voltage signals (i.e. second voltage level), and supplies the level-shifted voltage signal to scan driver 50 or power supply circuit 80.

9 Claims, 13 Drawing Sheets

LINE DRIVE CIRCUIT, ELECTRO-OPTIC DEVICE, AND DISPLAY DEVICE

BACKGROUND OF THE INVENTION

1. Field of the Invention

The present invention relates to a line driver circuit, and to an electro-optic device and a display device using the same.

2. Description of Related Art

Display panels, such as liquid crystal displays, are used as display units in electronic devices, such as cell phones for example, in an effort to achieve low power consumption and reduce the size and weight of the electronic devices. Since delivering video and still images with high content value has become possible with the rapid spread and acceptance of cell phones in recent years, high image quality has also become necessary for display panels in cell phones, and other devices used to deliver video/image contents.

Active matrix liquid crystal panels using thin film transistor ("TFT" below) liquid crystals are known as one type of liquid crystal panel achieving high image quality in the display unit of such electronic devices. Organic EL panels using organic EL elements are another type.

In an active matrix liquid crystal panel using TFT liquid crystals, a high voltage is required for driving the display, the value of the high voltage being dependent upon the liquid crystal material and TFT transistor capacity. As a result, the driver circuit (line driver circuit) and power supply circuit for driving an active matrix, LCD panel display, must be manufactured using a high breakdown voltage process.

There is therefore a problem that even as device geometry processes continues to get smaller, the benefits of low cost offered by reduced dimensions cannot be realized in LCD panel drivers.

OBJECT OF THE INVENTION

The present invention is directed toward solving the technical problems described above.

An object of the invention is to provide a line driver circuit of reduced cost by applying a smaller design rule than previously practical, and to provide an electro-optic device and display apparatus using this line driver circuit.

SUMMARY OF THE INVENTION

To achieve these objects, a first line driver circuit according to the present invention for driving a first line of an electro-optic device (which preferably has pixels identified by a plurality of first lines and a plurality of intersecting second lines) has an input terminal that receives signals from a display controller (which controls the display of the electro-optic device). The signals applied to the input terminal are to be supplied to a second line driver circuit for driving the second lines. The first line driver includes a level shifter circuit for shifting signals applied to its input terminal to a specified voltage, and includes an output terminal for outputting to the second line driver circuit the signals shifted to the specified voltage.

The electro-optic device may include: scan lines 1 to N; intersecting signal lines 1 to M; N×M switching means connected to scan lines 1 to N and to signal lines 1 to M; and N×M pixel electrodes connected to the N×M switching means. The electro-optic device could be an organic EL panel.

The first line driver circuit and the second line driver circuit cooperate under the control of the display controller to control pixels identified (i.e. addressed) by first and second lines. The first line driver circuit according to the present invention receives signals to be supplied to the second line driver circuit from the display controller, shifts these signals to a specific voltage level, and then supplies the level-shifted signals to the second line driver circuit. It is therefore possible to relay required display driver signals from a display controller (with a complex circuit configuration and excellent general utility) to the second line driver circuit requiring a high driving voltage through a first line driver circuit having a relatively simple circuit configuration, which enables it to be manufactured using a low cost process. It is therefore not necessary to provide a high breakdown voltage interface circuit in the display controller, which was previously, typically required for supplying signals directly to the second line driver circuit. Cost reductions can therefore be achieved by reducing the feature size and using the most advanced low voltage processes.

Another aspect of the present invention is a line driver circuit for driving a first line of an electro-optic device having pixels identified by a plurality of first lines and a plurality of intersecting second lines, comprising: an input terminal to which signals to be supplied to a power supply circuit are input from a display controller for controlling the display on the electro-optic device; a level shifter circuit for shifting signals input to the input terminal to a specified voltage; and an output terminal for outputting signals shifted to the specified voltage to the power supply circuit.

This power supply circuit could have a function of supplying multiple voltage levels such as gradation voltages in addition to high and low potential voltages.

Thus comprised, a line driver circuit and power supply circuit cooperate under the control of a display controller to control pixels identified by first and second lines. Of these, a line driver circuit according to the present invention receives signals to be supplied to the power supply circuit from the display controller, shifts these signals to a specific voltage level, and then supplies the level-shifted signals to the power supply circuit. It is therefore possible to relay required display drive signals from a display controller with a complex circuit configuration and excellent general utility to the power supply circuit requiring high voltage drive through a line driver circuit with a relatively simple circuit configuration enabling manufacturing in a low cost process. It is therefore not necessary to provide the high breakdown voltage interface circuit required for supplying signals directly to the power supply circuit in the display controller, and cost reductions can be achieved by reducing feature size using the most advanced low voltage processes.

Preferably, the first line is a signal line for supplying a voltage based on image data.

Thus comprised, signals to be supplied to the circuits are relayed by the signal drive circuit for driving the signal lines, for example. This makes it possible to reduce the cost of the display controller for controlling the signal drive circuit.

Yet further preferably the line driver circuit of the invention also has a plurality of selector lines; a first selector circuit for connecting the input terminal and a first selector line selected from among a plurality of selector lines based on a specific first selection signal; and a second selector circuit for connecting the output terminal to the first selector line based on a specific second selection signal.

Thus comprised, various desirable input terminals and output terminals can be set because the first and second terminal groups are connected by the first and second selector circuits and one of multiple selector lines. It is therefore possible to receive signals from the display controller through a selected desirable terminal of the line driver circuit, and to output the signal from a desired terminal to a downstream supply connection.

Yet further preferably, the line driver circuit also has a first output buffer circuit for converting the first selector line voltage to the voltage of a low voltage process and supplying the converted voltage to the output terminal; a second output buffer circuit for converting the first selector line voltage to a voltage of a high voltage process and supplying the converted voltage to the output terminal; a first input buffer circuit for supplying a voltage of a low voltage process supplied to the input terminal as a low voltage process voltage to the first selector line; and a second input buffer circuit for converting a voltage of a high voltage process supplied to the input terminal to a voltage of a low voltage process, and supplying the converted voltage to the first selector line. The buffers are exclusively controlled so that only one of the first and second output buffer circuits and first and second input buffer circuits is set to an operating mode at any one time and the other buffer circuits are simultaneously set to a non-operating mode.

Thus comprised, a circuit for supplying a voltage of an internal low voltage process directly as the voltage of a low voltage process or converting it to the voltage of a high voltage process, or taking the voltage for an internal low voltage process from the voltage of an external low or high voltage process, can be disposed to each terminal by means of the first and second output buffers and first and second input buffers. It is therefore possible to use any terminal as an input terminal or an output terminal. Usability is thus significantly improved.

An electro-optic device according to a further aspect of the invention has pixels identified by a plurality of first lines and a plurality of intersecting second lines; a line driver circuit as described above; and a second line driver circuit for driving the second lines.

The invention can thus provide an electro-optic device enabling display controller cost to be reduced by applying a smaller design rule.

A display apparatus according to a further aspect of the invention is comprised of an electro-optic device having pixels identified by a plurality of first lines and a plurality of intersecting second lines; a line driver circuit as described above; and a second line driver circuit for driving the second lines.

The invention can thus provide a display apparatus enabling display controller cost to be reduced by applying a smaller design rule.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Preferred embodiments of the present invention are described below with reference to the accompanying figures.

1. Display Apparatus 1.1 Configuration of the Display Apparatus

Figure 1:
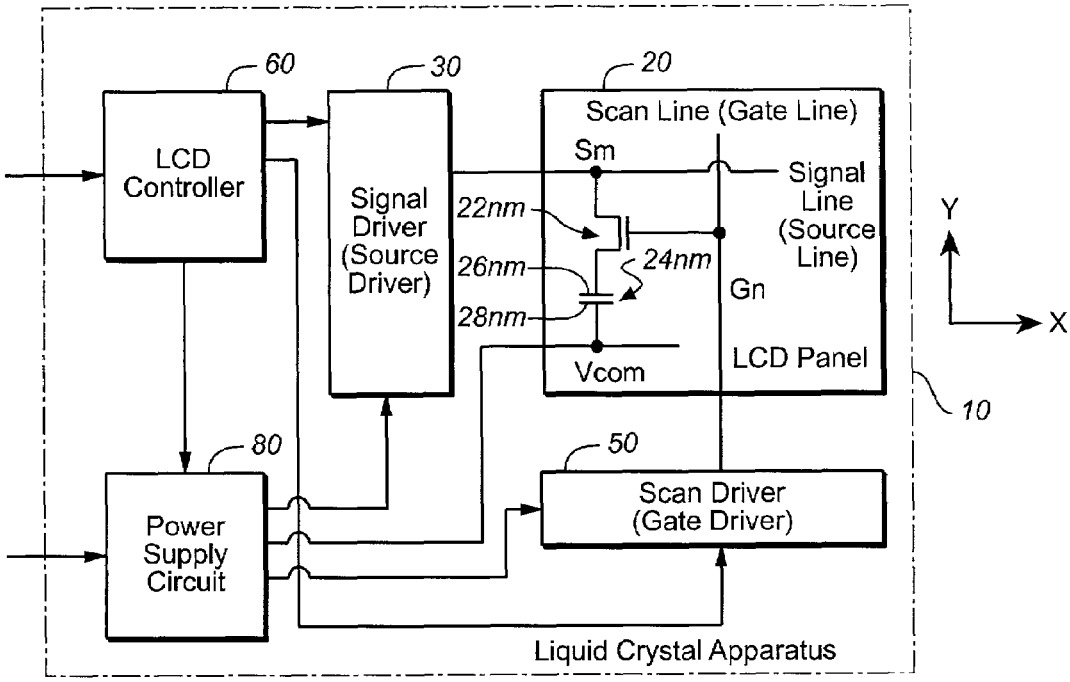
FIG. 1 is a block diagram showing the basic configuration of a display apparatus containing a line driver circuit according to a preferred embodiment of the invention.

The basic configuration of a display apparatus containing a line driver circuit according to the present embodiment of the invention is shown in FIG. 1. The liquid crystal display system 10 according to the present embodiment of a display apparatus of the invention has a liquid crystal display (LCD) panel 20, a signal driver 30 (i.e. a signal drive circuit, a line driver circuit, or more specifically, a source driver), a scan driver 50 (i.e. a scan drive circuit, or more specifically, a gate driver), an LCD controller 60 (more broadly, a display controller), and a power supply circuit 80. The LCD panel (or broadly speaking, any electro-optic device) 20 is formed on a glass substrate, for example. A plurality of scan lines (that is, gate lines or second lines) G1 to Gn (only Gn is shown), where n is a natural number of 2 or more, are disposed in the Y-direction and traverse the X-direction on this glass substrate. A plurality of signal lines (that is, source lines or first lines) S1 to Sm (only Sm is shown), where m is a natural number of 2 or more, are disposed in the X-direction and traverse the Y-direction on this glass substrate. A TFT 22*nm* (broadly speaking, a switching means) is disposed at the intersection of each scan line and signal line. For example TFT 22*nm* is disposed at the intersection of scan line Gn (where 1·n·N and n is a natural number) and signal line Sm (where 1·m·M and m is a natural number).

The gate of TFT 22*nm* is connected to scan line Gn. The source of TFT 22*nm* is connected to signal line Sm. The drain of TFT 22*nm* is connected to pixel electrode 26*nm* of liquid crystal capacitor 24*nm* (broadly speaking, a liquid crystal element having an inherent capacitance). Liquid crystal is sealed in LCD capacitor 24*nm* between pixel electrode 26*nm* and the opposing electrode 28*nm*, and the light transmittance of the pixel changes according to the applied voltage between these electrodes.

Opposing electrode voltage Vcom generated by power supply circuit 80 is supplied to the opposing electrode 28*nm*.

Signal driver 30 drives signal lines S1 to Sm of LCD panel 20 based on pixel data for one horizontal scan unit.

More specifically, the signal driver 30 sequentially latches serial input image data and generates the image data for one horizontal scanning unit. Then, synchronized to the horizontal synchronization signal, the signal driver 30 drives each signal line at a drive voltage based on this image data.

Synchronized to the horizontal synchronization signal, the scan driver 50 sequentially drives scan lines G1 to Gn in one vertical scanning period.

More specifically, the scan driver 50 has a flip flop for each scan line 1-n and a shift register to which the flip flops are sequentially connected. The scan driver 50 sequentially selects each scan line in one vertical scanning period by sequentially shifting the vertical synchronization signal supplied from LCD controller 60.

The LCD controller 60 controls signal driver 30, scan driver 50, and power supply circuit 80 according to content set by a host, such as a central processing unit (CPU), not shown in the figures. More specifically, the LCD controller 60 supplies operating mode settings and the internally generated vertical synchronization signal and horizontal synchronization signal to signal driver 30 and scan driver 50, and supplies the polarization inversion timing of the opposing electrode voltage Vcom to the power supply circuit 80.

Based on an externally supplied reference voltage, power supply circuit 80 generates opposing electrode voltage Vcom and also generates the voltage levels required to drive the liquid crystals of the LCD panel 20. These various voltage levels are supplied to signal driver 30, scan driver 50, and LCD panel 20. The opposing electrode voltage Vcom is supplied to an opposing electrode disposed opposite the TFT pixel electrodes of the LCD panel 20.

In a liquid crystal apparatus 10 thus comprised, signal driver 30, scan driver 50, and power supply circuit 80 cooperatively drive LCD panel 20 based on externally supplied image data, as controlled by LCD controller 60, to display an image on LCD panel 20.

It should be noted that although LCD controller 60 is included in the configuration of the liquid crystal apparatus 10 shown in FIG. 1, the LCD controller 60 can be disposed external to the liquid crystal apparatus 10. It is also possible to incorporate both the LCD controller 60 and host (i.e. cpu) within the liquid crystal apparatus 10.

1.2 Liquid Crystal Drive Wave

Figure 2:
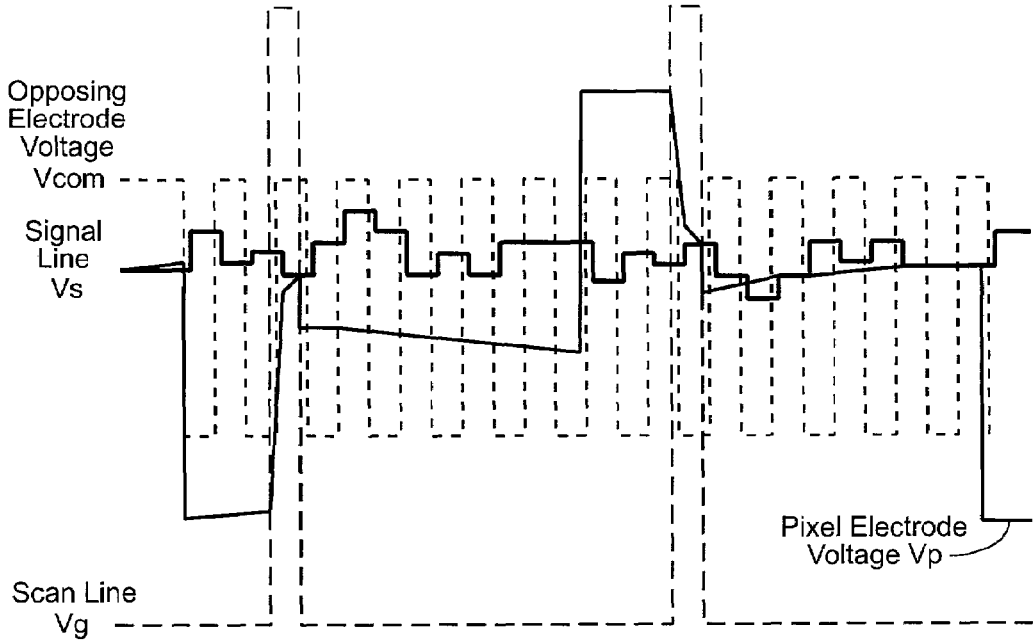
FIG. 2 shows an example of a driving wave, and other signals, for an LCD panel in a display apparatus in accord with a preferred embodiment of the invention.

FIG. 2 shows an example of a drive wave for the LCD panel 20 in the liquid crystal apparatus 10 described above. A line inversion drive method is shown here.

Signal driver 30, scan driver 50, and power supply circuit 80 are controlled according to the display timing generated by the LCD controller 60 in this liquid crystal apparatus 10. The LCD controller 60 sequentially passes image data for one horizontal scanning unit to the signal driver 30, and supplies polarity inversion signal POL indicating the internally generated horizontal synchronization signal and inversion drive timing. The LCD controller 60 also supplies the internally generated vertical synchronization signal to the scan driver 50, and supplies opposing electrode voltage polarity inversion signal VCOM to the power supply circuit 80.

As a result, the signal driver 30 drives signal lines based on image data for one horizontal scanning unit synchronized to the horizontal synchronization signal. Triggered by the vertical synchronization signal, the scan driver 50 drives the scan lines connected to the gates of the TFTs arrayed in a matrix on the LCD panel 20 with sequential drive voltage Vg. The power supply circuit 80 inverts the polarity of the internally generated opposing electrode voltage Vcom synchronized to the opposing electrode voltage polarity inversion signal VCOM while supplying the opposing electrode voltage Vcom to the opposing electrodes of the LCD panel 20.

A charge corresponding to the voltage Vcom of the pixel electrode connected to the drain of TFT 22*nm* and the opposing electrode charges the liquid crystal capacitor 24*nm*. Image display is possible when the pixel electrode voltage Vp held by the charge stored in the liquid crystal capacitor exceeds a particular threshold value VCL. When the pixel electrode voltage Vp exceeds this particular threshold value VCL, pixel transmittance changes according to the voltage level, and a gray scale display is possible.

2. Features of the Present Embodiment

The voltage required to drive the display of an LCD apparatus is different for the various other semiconductor devices, such as LCD controller 60, signal driver 30, scan driver 50, and power supply circuit 80.

Figure 3:
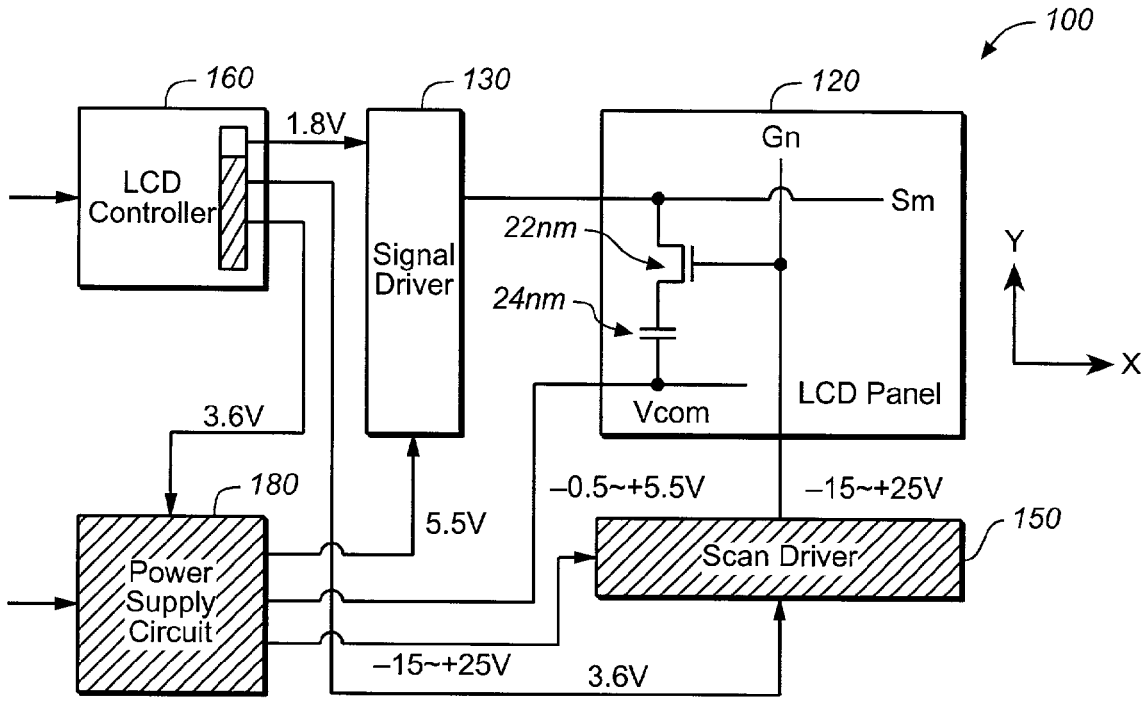
FIG. 3 shows an example of connections between semiconductor devices in an LCD apparatus.

FIG. 3 shows an example of the connections between semiconductor devices in an LCD apparatus.

The preferred supply voltage level of the signals communicated between the semiconductor devices is also shown here.

The LCD panel 120, signal driver 130, scan driver 150, LCD controller 160, and power supply circuit 180 of this liquid crystal apparatus 100 have the same function as the corresponding parts of the liquid crystal apparatus 10 shown in FIG. 1.

For example, the signal driver 130 is manufactured with a medium voltage process to balance integration and low cost, such as a 0.35 micron process, instead of the most advanced design rule process because the circuit design is not particularly complicated.

The scan driver 150 does not require shrinking due to its simple circuit design, and is manufactured in a high voltage process in order to drive a high voltage (such as 20 V to 50 V), as determined by the relationship between the liquid crystal material and TFT performance.

The power supply circuit 180 generates the high voltage supplied to the scan driver 150, and is therefore manufactured in a high breakdown voltage process.

The LCD controller 160 has a complex circuit configuration and a wide range of applications, and its cost can be greatly reduced by reducing the chip size. The LCD controller 160 is therefore manufactured in the most advance design rule process (such as a 0.18 micron process). Specifically, because the LCD controller 160 is manufactured in a low voltage process, it has both a low voltage process interface circuit and a high voltage process interface circuit.

The low voltage process interface circuit supplies a signal generated at the supply level of the low breakdown voltage design rule process to signal driver 130, which is manufactured in a medium breakdown voltage process. The high voltage process interface circuit supplies a signal shifted to the supply level for the high breakdown voltage process to the scan driver 150 and power supply circuit 180, which are manufactured in a high breakdown voltage process.

The LCD controller 160 thus also has a high voltage process interface circuit. The area of this high voltage process interface circuit cannot be made smaller in the IC even as the design rule gets smaller because the design rule includes physical limits needed to assure a sufficient breakdown voltage. It is therefore not possible to derive much benefit from the cost reductions enabled by design rule reduction.

In a liquid crystal apparatus 10 according to the present invention, however, the signal group to be supplied from LCD controller 60 (which is manufactured in a low breakdown voltage process) to scan driver 50 and power supply circuit 80 (manufactured in a high breakdown voltage process) passes first through the signal driver 30 (which is manufactured in a medium breakdown voltage process), and the signal group is then passed from the signal driver 30 to the scan driver 50 and power supply circuit 80.

Figure 4:
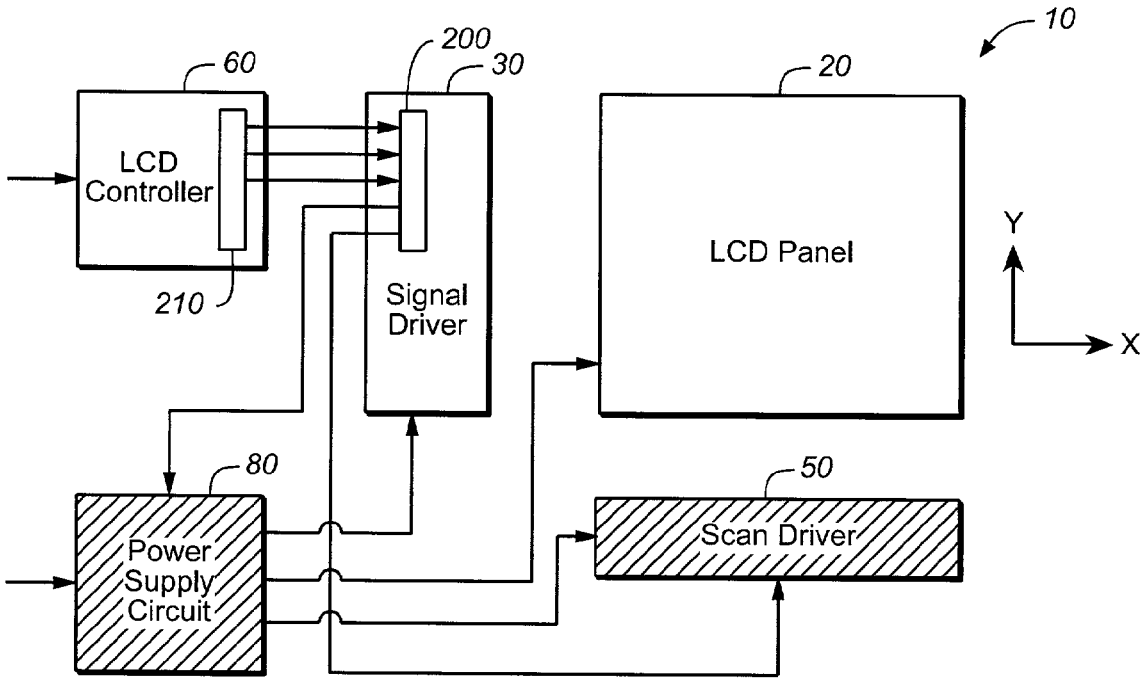
FIG. 4 shows an example of connections between various semiconductor devices in an LCD apparatus according to a preferred embodiment of the invention.

FIG. 4 shows an example of connections between various semiconductor devices in a LCD apparatus according to this embodiment of the invention.

The signal driver 30 of the present embodiment thus includes interface unit 200, which itself includes an interface circuit constructed with a medium voltage process and effective for converting voltages from low voltage processed components to the voltage of high voltage processed components. Interface unit 200 receives the low voltage signal group supplied from LCD controller 60, and then supplies it to the scan driver 50 or power supply circuit 80 after converting it to the high voltage suitable for the high voltage process.

This makes it unnecessary to provide an interface circuit for driving a high voltage in interface unit 210 of the LCD controller 60. This enables complex circuit configurations to be scaled down and enables the cost to be reduced in conjunction with reductions in process dimensions.

2.1 Configuration Principle of the Present Embodiment

Figure 5:
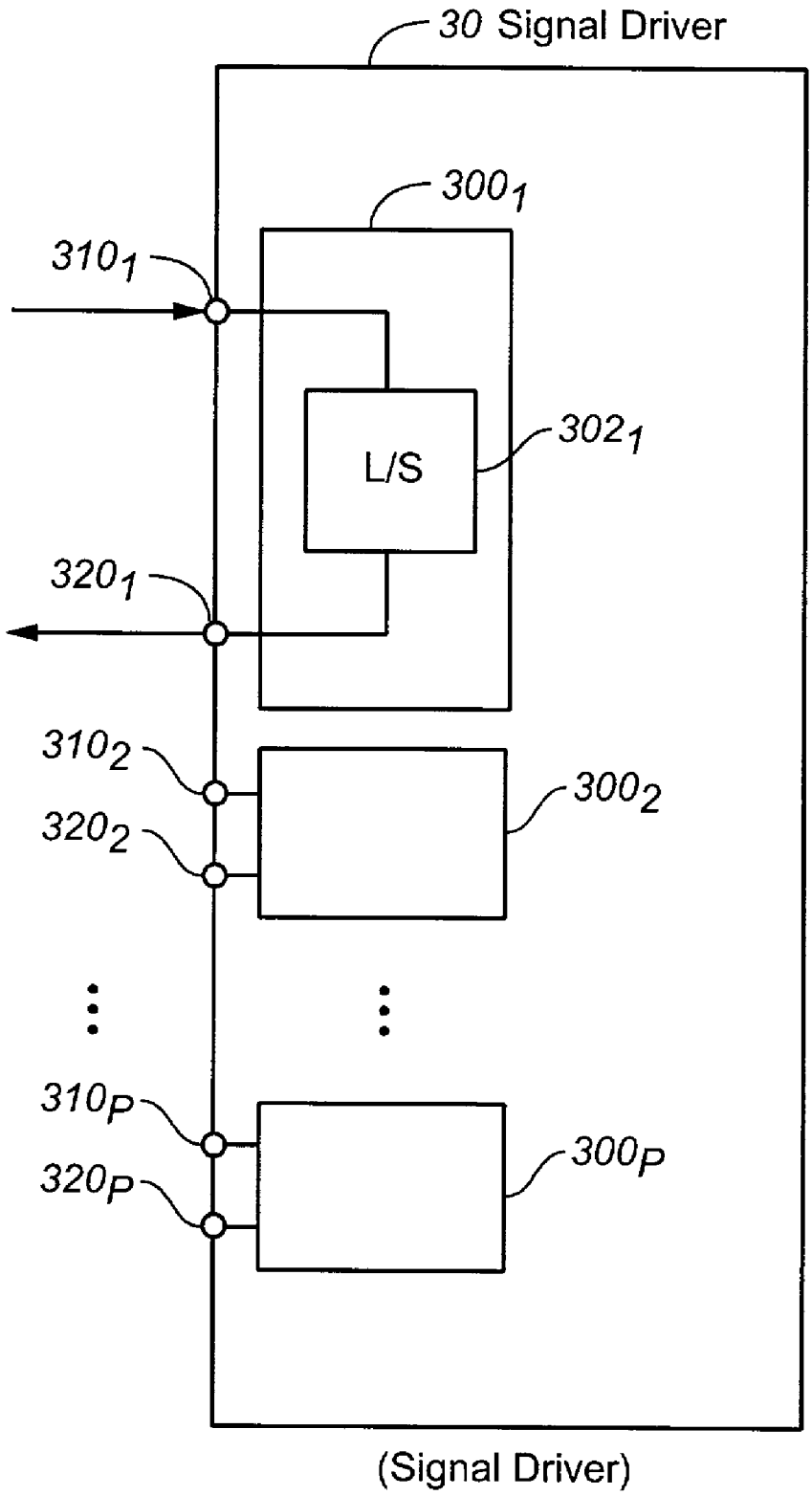
FIG. 5 shows the configuration principle of the signal driver in the present embodiment.

FIG. 5 illustrates the principle of the signal driver 30 configuration in accord with the present embodiment.

Signal driver 30 has I/O circuits $\mathbf{300}_1$ to $\mathbf{300}_P$ (where P is a natural number), and has input terminals $\mathbf{310}_i$ and output terminals $\mathbf{320}_i$ corresponding to each I/O circuit $\mathbf{300}_i$ (where 1·i·P, and i is a natural number).

Each I/O circuit $\mathbf{300}_i$ includes a corresponding level shifter $\mathbf{302}_i$ for converting a relatively low voltage from the low breakdown voltage side to a higher voltage for the high breakdown voltage side.

Level shifter $\mathbf{302}_i$ converts the voltage magnitude of signals from the low breakdown voltage side input applied at input terminals $\mathbf{310}_i$ to higher voltage magnitudes for the high breakdown voltage side supplied at the level-shifter output to output terminals $\mathbf{320}_i$. Therefore, the cost of LCD controller 60 can be reduced by applying a smaller design rule in its construction, since the outputs of LCD controller 60 are connected to input terminals $\mathbf{310}_1$ to $\mathbf{310}_P$, and output terminals $\mathbf{320}_1$ to $\mathbf{320}_P$ are connected to either scan driver 50 or power supply circuit 80, which are manufactured in high voltage processes.

3. Signal Driver (Line Driver Circuit) in this Embodiment

The signal driver 30 (line driver circuit) is described below in more detail.

Figure 6:
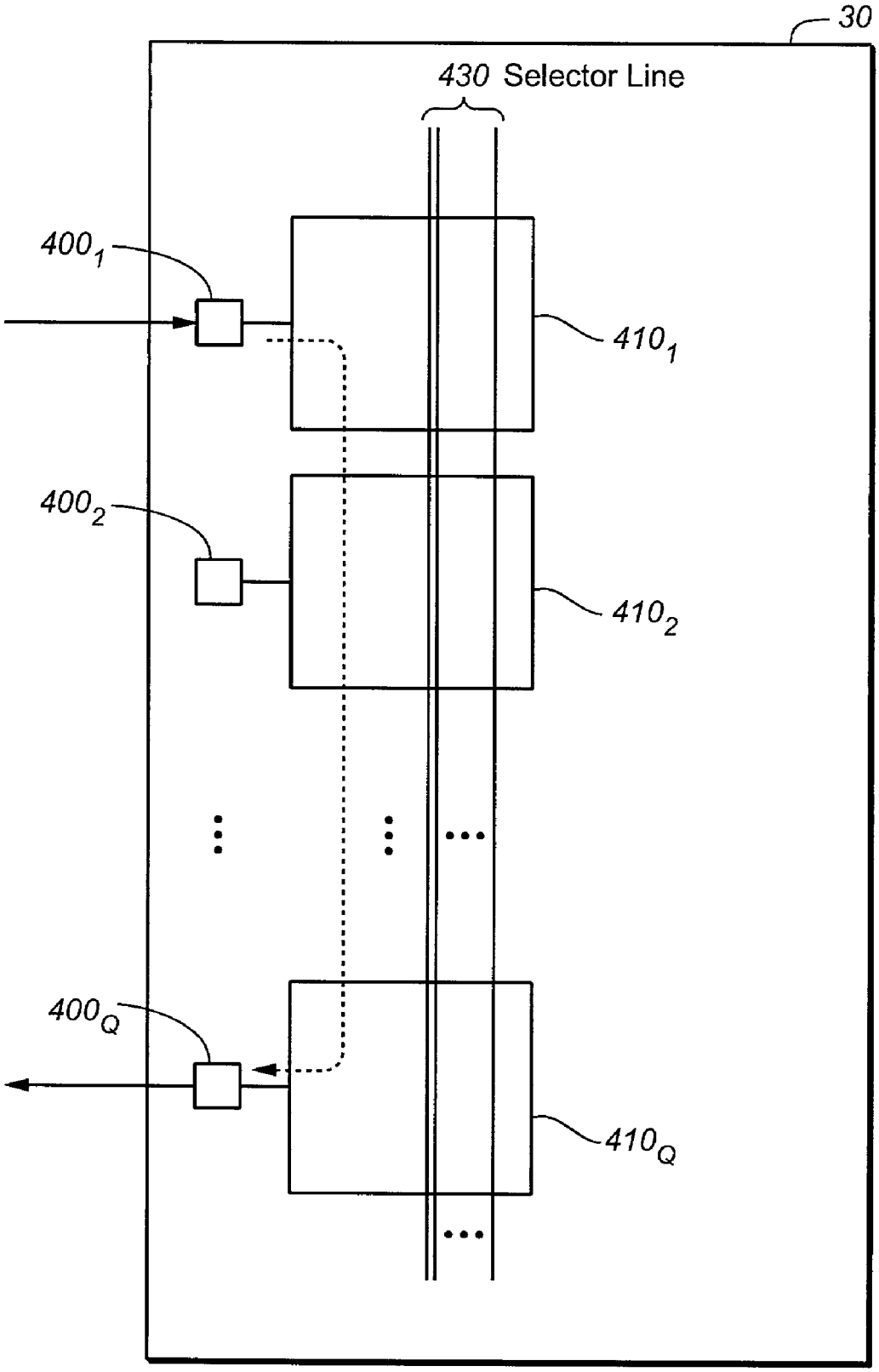
FIG. 6 shows a more detailed configuration of the signal driver of FIG. 5.

FIG. 6 shows the basic configuration of signal driver 30 in the present embodiment.

Signal driver 30 has input/output pads $\mathbf{400}_1$ to $\mathbf{400}_Q$ (where Q is a natural number) disposed according to the terminals of the semiconductor device. Signal driver 30 also has an I/O circuit $\mathbf{410}_j$ (wherein 1·j·Q and j is a natural number) corresponding to each I/O pad $\mathbf{400}_1$ to $\mathbf{400}_Q$. I/O circuits $\mathbf{410}_1$ to $\mathbf{410}_Q$ are commonly connected to one or more selector lines 430. It should be noted that there are preferably 16 selector lines 430 in this example.

Each I/O (i.e. input/output) circuit $\mathbf{410}_j$ has multiple selectively enabled input buffers and multiple selectively enabled output buffers, and can therefore function as either an input circuit or an output circuit depending upon an input/output selection signal. For example, if I/O circuit $\mathbf{410}_1$ is set to function as an input circuit and I/O circuit $\mathbf{410}_Q$ is set to function as an output circuit, then a signal applied to I/O pad $\mathbf{400}_1$ is input to I/O circuit $\mathbf{410}_1$, which then passes the input signal to a particular one of selector lines 430 (identified as a "first selector line" in the present example). High and low voltage signals applied to I/O pads $\mathbf{400}_1$ to $\mathbf{400}_Q$ from the high or low breakdown voltage side of signal driver 30 are converted to the appropriate output voltage level at this time.

I/O pad $\mathbf{400}_Q$ of I/O circuit $\mathbf{410}_Q$ is electrically coupled to the "first selector line" by a selector circuit (424*j* shown in FIG. 7 and described below). In this case signals carried on the first selector line are converted to the voltage level of the high or low breakdown voltage side, as appropriate.

It is therefore possible to convert signals having a first voltage level and applied to a selected input terminal to a second voltage level appropriate for output on a selected output terminal.

Figure 7:
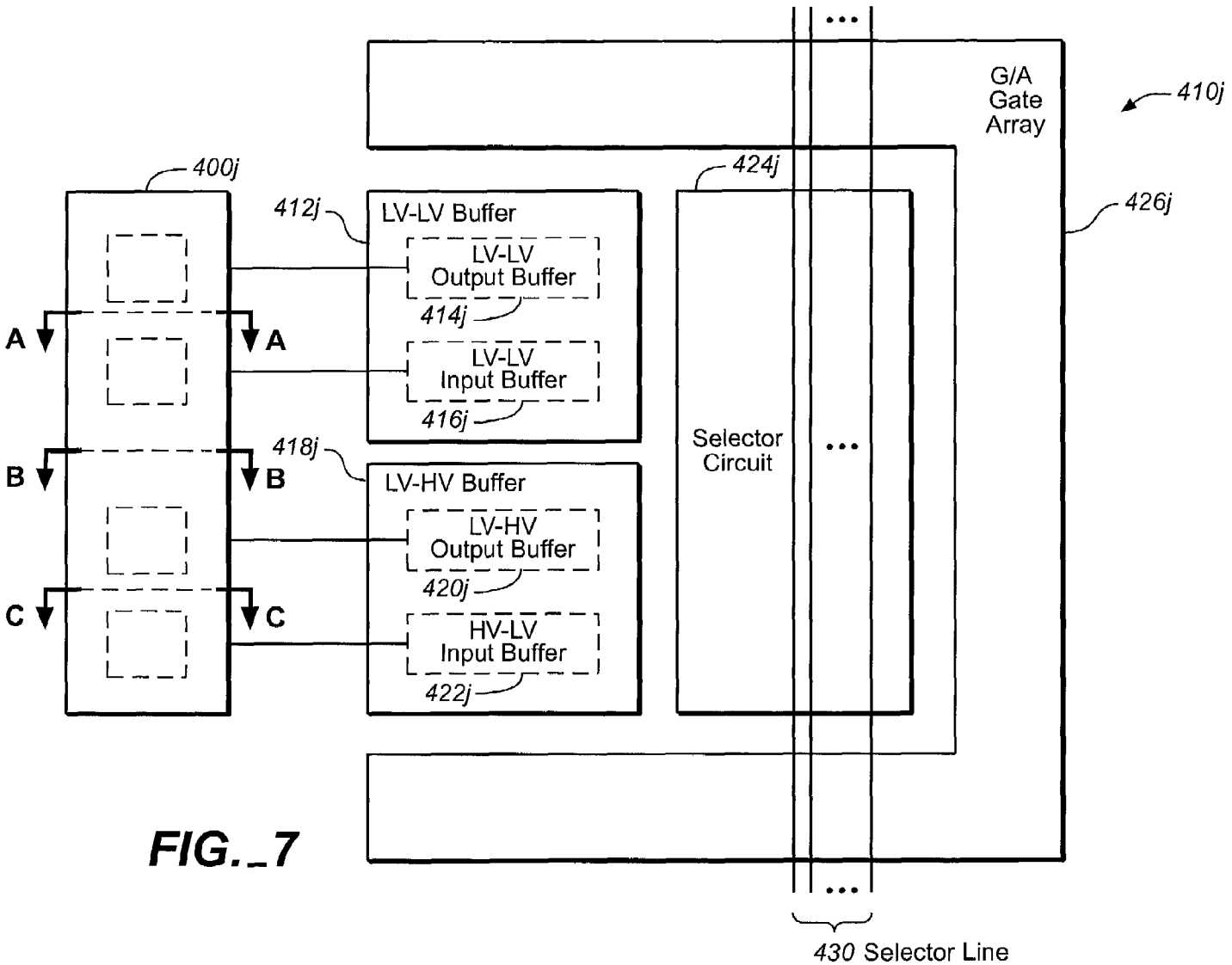
FIG. 7 is a schematic diagram showing the layout of an I/O circuit in a signal driver according to a preferred embodiment of the invention.

FIG. 7 is a schematic diagram showing the layout of each of the above-described I/O circuits 410*j*. Each of I/O circuits 410*j* (where 1·j·Q) include an LV-LV (low voltage to low voltage) buffer 412*j* electrically connected to the I/O pads 400*j*, an LV-HV (low voltage to high voltage) buffer 418*j*, a selector circuit 424*j*, and a gate array 426*j*. Note that LV denotes low voltage and HV denotes high voltage.

LV-LV buffer 412*j* includes an LV-LV output buffer 414*j* and an LV-LV input buffer 416*j*.

LV-LV output buffer 414*j* (first output buffer) buffers low voltage signals to a buffer circuit connected to an LV supply voltage level, and outputs to I/O pad 400*j*.

LV-LV input buffer 416*j* (first input buffer) buffers the voltage of LV signals input through I/O pad 400*j* to a buffer connected to an LV supply voltage level, and outputs to selector circuit 424*j*.

The LV-HV buffer 418*j* has an LV-HV output buffer 420*j* and HV-LV input buffer 422*j*.

The LV-HV output buffer 420*j* (second output buffer) is a circuit for converting the voltage of LV signals to the voltage of HV signals, and outputting the converted voltage signal to I/O pad 400*j*.

The HV-LV input buffer 422*j* (second input buffer) is a circuit for buffering the voltage of HV signals input through I/O pad 400*j* to a buffer circuit connected to an LV supply voltage level, and outputting to selector circuit 424*j*.

Selector circuit 424*j* connects LV-LV output buffer 414*j*, LV-LV input buffer 416*j*, LV-HV output buffer 420*j*, or HV-LV input buffer 422*j* to one of the selector lines 430.

Gate array 426*j* is a logic circuit for generating a control signal for exclusively operating LV-LV output buffer 414*j*, LV-LV input buffer 416*j*, LV-HV output buffer 420*j*, or HV-LV input buffer 422*j*, and the selection signal for selector circuit 424*j*.

LV-LV output buffer 414*j*, LV-LV input buffer 416*j*, LV-HV output buffer 420*j*, or HV-LV input buffer 422*j* are controlled by gate array 426*j* such that only one of the four buffers operates at any one time, i.e. to operate exclusively of the other three buffers, with this type of I/O circuit 410*j*. That is, the output of at least the unselected input buffers and output buffers is placed in a high impedance state. The selected input buffer or output buffer is electrically connected to a selector line, as specified by gate array 426*j*. The specified selector line is electrically coupled to a corresponding I/O pad through the I/O circuit.

By thus freely selecting particular I/O circuits and I/O pads and electrically connecting the selected I/O circuits through selector lines, the voltage of LV signals or HV signals can be converted and output between desired input and output terminals.

It should be noted that as shown in FIG. 7 LV and HV signal interface functions can be built in to I/O circuit 410*j* by breaking I/O pad 400*j* (which is formed by Al vapor deposition) into electrically isolated pads as indicated by lines A-A, B-B, and C-C.

Figure 8:
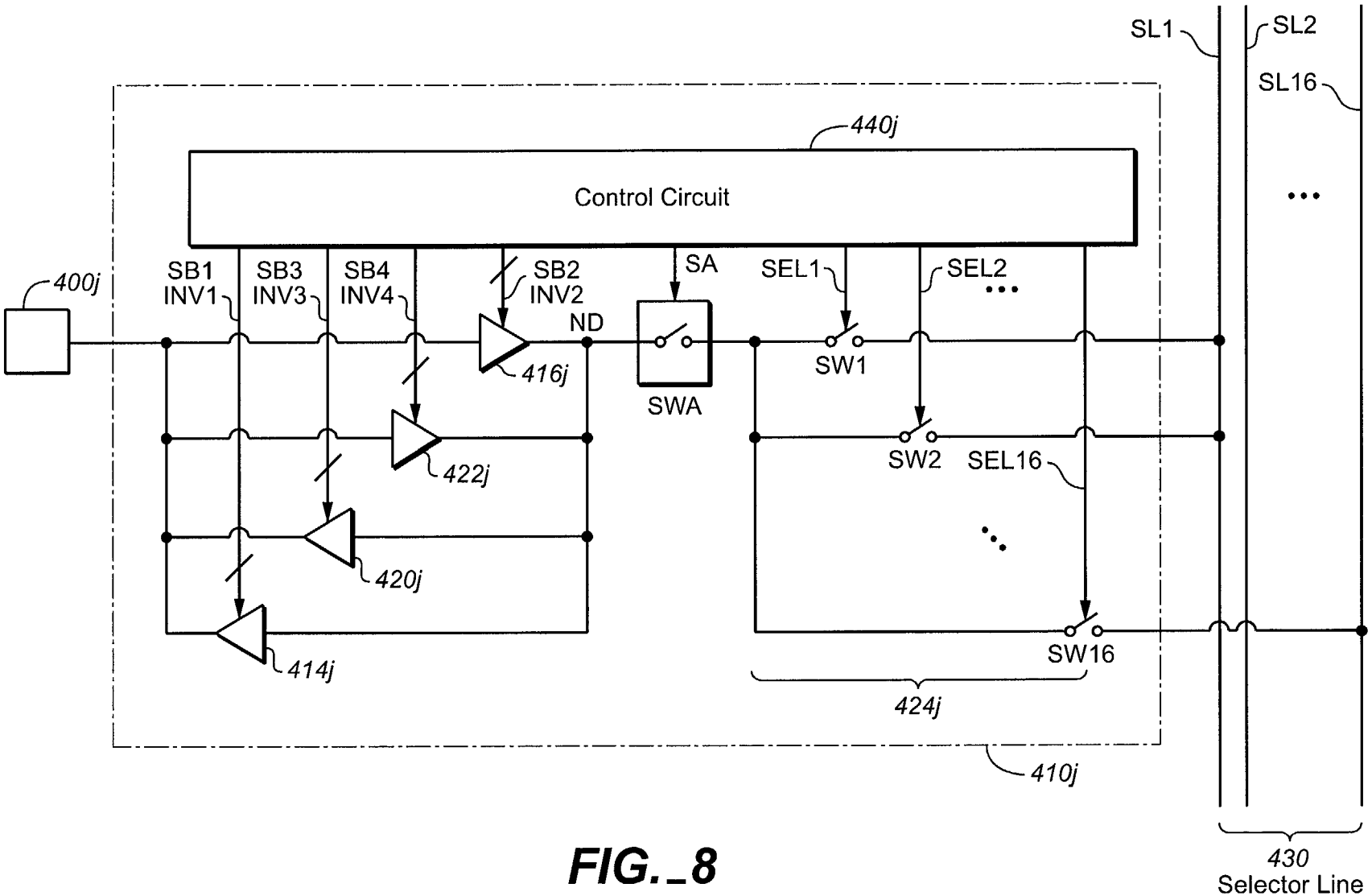
FIG. 8 shows an example of the circuit configuration of the I/O circuit in a preferred embodiment of the invention.

FIG. 8 shows an example of the circuit configuration of I/O circuit 410*j*.

I/O pad 400*j* is electrically connected to the output terminal of LV-LV output buffer 414*j*, the input terminal of LV-LV input buffer 416*j*, the output terminal of LV-HV output buffer 420*j*, and the input terminal of HV-LV input buffer 422*j*.

The input terminal of LV-LV output buffer 414*j* is electrically connected at node ND to the output terminal of LV-LV input buffer 416*j*, the input terminal of LV-HV output buffer 420*j*, the output terminal of HV-LV input buffer 422*j*. Node ND functions as a terminal of the switching circuit SWA.

The other terminal of switching circuit SWA is connected to selector lines SL1 to SL16 through selector circuit 424*j*, which contains selector switches SW1 to SW16.

Control signals SB1 to SB4 exclusively select any one of the buffers. Switching control signal SA switches circuit SWA on and off. Selection signals SEL1 to SEL16 for alternatively select selector switches SW1 to SW16. These control signals are generated by control circuit 440*j*. As shown in FIG. 7, this control circuit 440*j* is comprised of a gate array. The control circuit 440*j* generates control signals SB1 to SB4 and selection signals SEL1 to SEL16 according to set content from the host (not shown in the figure).

Switching circuit SWA reduces the output load of LV-LV input buffer 416*j* and HV-LV input buffer 422*j* by electrically isolating the buffers and selector switches SW1 to SW16. This makes it possible to shrink the LV-LV input buffer 416*j* and HV-LV input buffer 422*j*.

It should be noted that in the present embodiment LV-LV output buffer 414*j*, LV-LV input buffer 416*j*, LV-HV output buffer 420*j*, and HV-LV input buffer 422*j* are configured to invert the logic level of their respective input logic (that is, invert the phase), and to output the inverted signal according to control signals SB1 to SB4 and inversion control signals INV1 to INV4 supplied from control circuit 440*j*.

The specific configuration of each buffer is described next below.

The LV supply voltage is denoted below as VCC, the HV supply voltage is denoted as VDD, and the ground level is denoted as VSS. The inverse of control signal CONT is XCONT. Similarly, the inverse logic of any signal is denoted by an "X" in front of the signal name.

Figure 9:
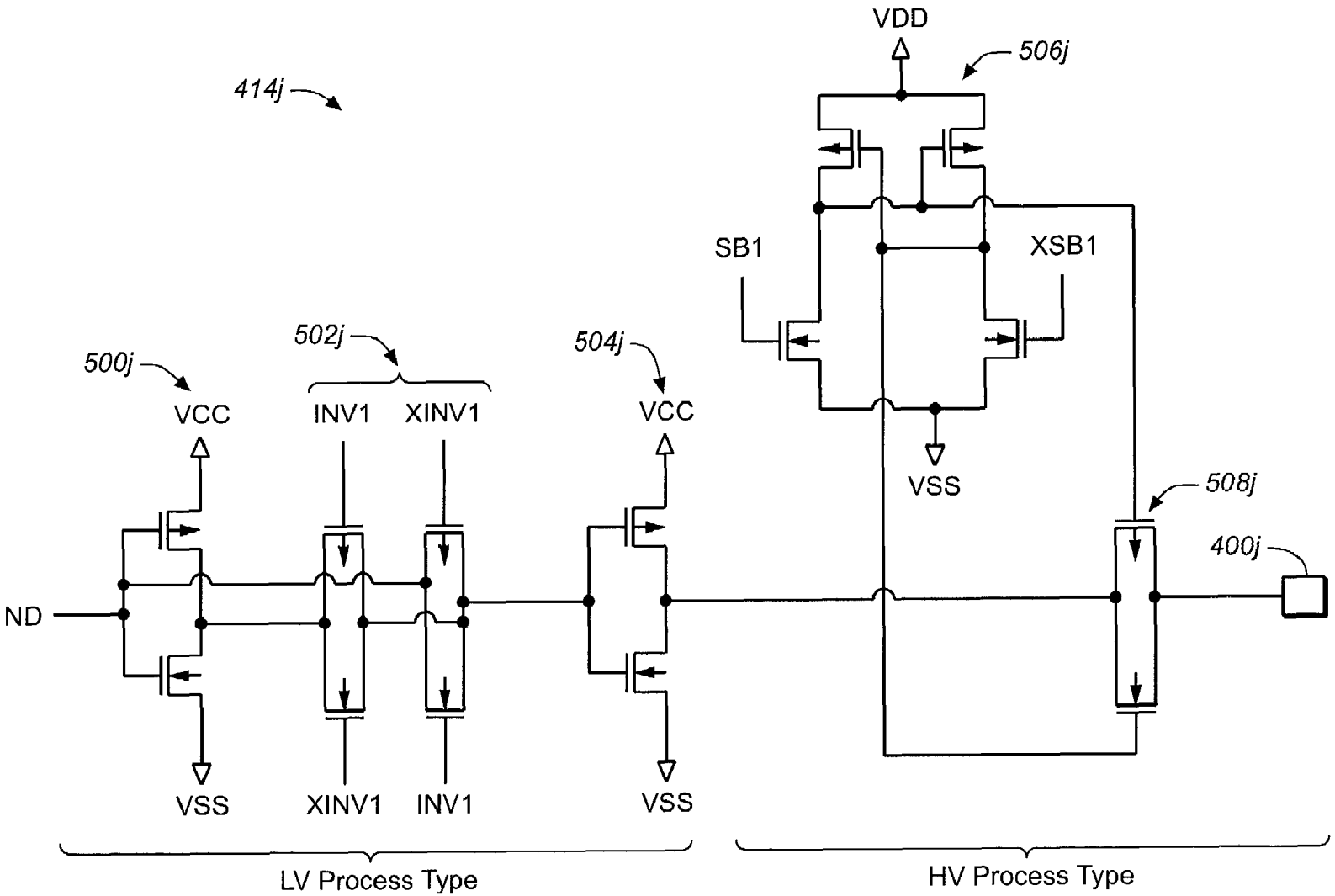
FIG. 9 shows an example of the circuit configuration of an LV-LV output buffer in a preferred embodiment of the invention.

FIG. 9 shows an example of the circuit configuration of LV-LV output buffer 414*j*.

LV-LV output buffer 414*j* has inverter circuits 500*j* and 504*j*, multiplexor 502*j*, level shifter 506*j*, and transfer circuit 508*j*. Multiplexor 502*j* is responsive to control signal INV (and its inverse XINV) to selectively pass either the inverted or non-inverted version of signal ND to inverter circuit 504*j*. Inverter 500*j* and multiplexor 502*j* together form an XOR (exclusive OR) logic gate responsive to signals INV and ND as inputs, and outputting the XOR combination of signals INV and ND to the input of inverter 504*j*.

Level shifter 506*j* and transfer circuit 508*j* are comprised of HV transistors. Inverter circuits 500*j* and 504*j* and multiplexor 502*j* are LV transistors. HV transistors are formed with a thicker oxide film than LV transistors in order to achieve a higher breakdown voltage. The design rules for HV transistors must therefore be larger than those for LV transistors, and circuit area necessarily increases.

The level shifter 506*j* outputs an HV level voltage on one of its outputs as determined by the logic level of control signal SB1 (and its inverted control signal XSB1). The output of level shifter 506*j* controls the on/off state of transfer circuit 508*j*.

Input node ND is connected to the input node of inverter circuit 500*j*.

The input node and output node of inverter circuit 500*j* are connected to multiplexor 502*j*. Multiplexor 502*j* together with inverter 500*j* constitute an XOR and obtain the exclusive OR of the logic levels of inversion control signal INV1 and input node ND, and supply the result to the input node of inverter circuit 504*j*.

The output node of inverter circuit 504*j* is selectively coupled to I/O pad 400*j* through transfer circuit 508*j*.

LV-LV output buffer 414*j* is thus able to selectively invert the logic level of input node ND based on inversion control signal INV1. The output node is connected to I/O pad 400*j* through HV transfer circuit 508*j*. Damage to LV transistors resulting from mistaken supply of an HV level voltage to the I/O pad 400*j* can thus be avoided and reliability be maintained. Furthermore, because logic level inversion can be freely controlled by inversion control signal INV1, design changes due to changes in external interface specifications can be avoided, and the development time can be shortened.

Figure 10:
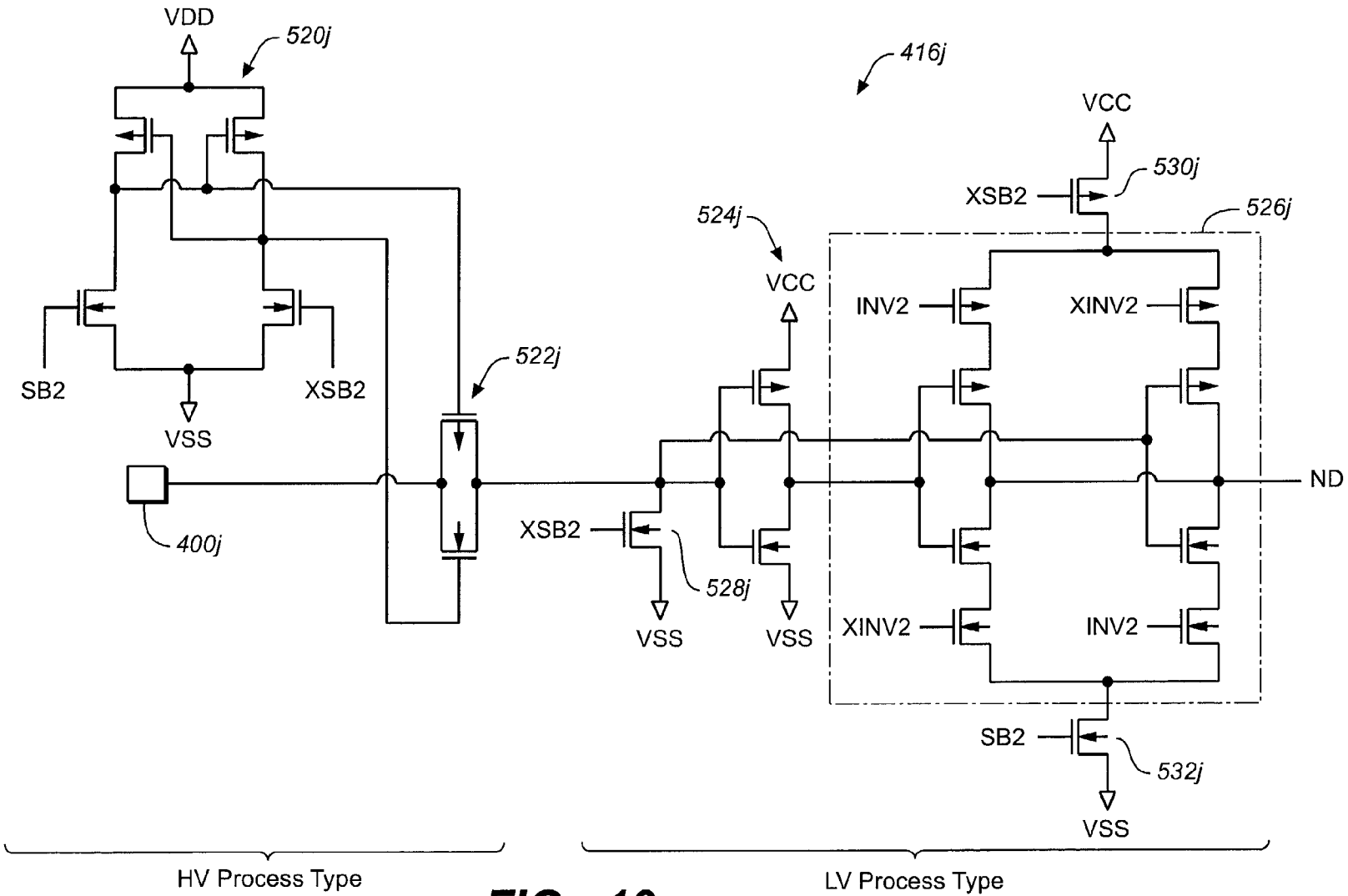
FIG. 10 shows an example of the circuit configuration of an LV-LV input buffer in a preferred embodiment of the invention.

FIG. 10 shows an example of the circuit configuration of LV-LV input buffer 416*j*.

The LV-LV input buffer 416*j* has a level shifter 520*j*, a transfer circuit 522*j*, an inverter circuit 524*j*, and a multiplexor circuit 526*j*. Inverter circuit 524*j* and multiplexor circuit 526*j* together functions as an XOR circuit.

The level shifter 520*j* and transfer circuit 522*j* are comprised of HV transistors. Inverter circuit 524*j* and multiplexor circuit 526*j* are comprised of LV transistors.

Level shifter 520*j* outputs an HV level voltage on one of its outputs as determined by the logic level of control signal SB2 (and its logic complement, i.e. the inverted control signal XSB2). The output of level shifter 520*j* controls the on/off state of transfer circuit 522*j*.

The I/O pad 400*j* is selectively coupled to inverter circuit 524*j* (comprised of LV transistors) through transfer circuit 522*j*.

It should be noted that n-type transistor 528*j* is connected between the input node of inverter circuit 524*j* and ground level VSS. Inverted signal XSB2 of control signal SB2 is supplied to the gate of n-type transistor 528*j*. Therefore, when inverted signal XSB2 is HIGH and LV-LV input buffer 416*j* is not selected, the voltage of the input node to inverter circuit 524*j* can be fixed to ground level VSS through n-type transistor 528*j*, and current passing through inverter circuit 524*j* when unselected can be reduced.

The input node and output node of inverter circuit 524*j* are connected to multiplexor circuit 526*j*. Multiplexor circuit 526*j* in combination with inverter circuit 424*j* achieves the exclusive OR function of the logic levels of the inversion control signal INV2 and the input node of inverter circuit 524*j*, and the result determines the logic level of node ND.

Multiplexor circuit 526*j* is connected to LV supply voltage VCC through p-type transistor 530*j*, and to ground level VSS through n-type transistor 532*j*. The inverted control signal XSB2 is supplied to the gate of p-type transistor 530*j*, and control signal SB2 is supplied to the gate of n-type transistor 532*j*.

Therefore, when LV-LV input buffer 416*j* is selected, the result of the above exclusive OR operation is output from node ND, and when LV-LV input buffer 416*j* is not selected node ND is in a high impedance state.

The LV-LV input buffer 416*j* thus receives signals from I/O pad 400*j* through HV transfer circuit 522*j*, and can freely invert the logic level by means of XOR circuit combination 524*j*/526*j*. As a result, reliability is not impaired even when an HV level voltage (VDD for reference high) is mistakenly supplied to I/O pad 400*j*, and an LV level voltage (VCC for reference high) can be supplied to node ND. Furthermore, because the logic level can be freely inverted as controlled by inversion control signal INV2, design changes due to a change in external interface specifications can be avoided and the development time can be shortened.

Figure 11:
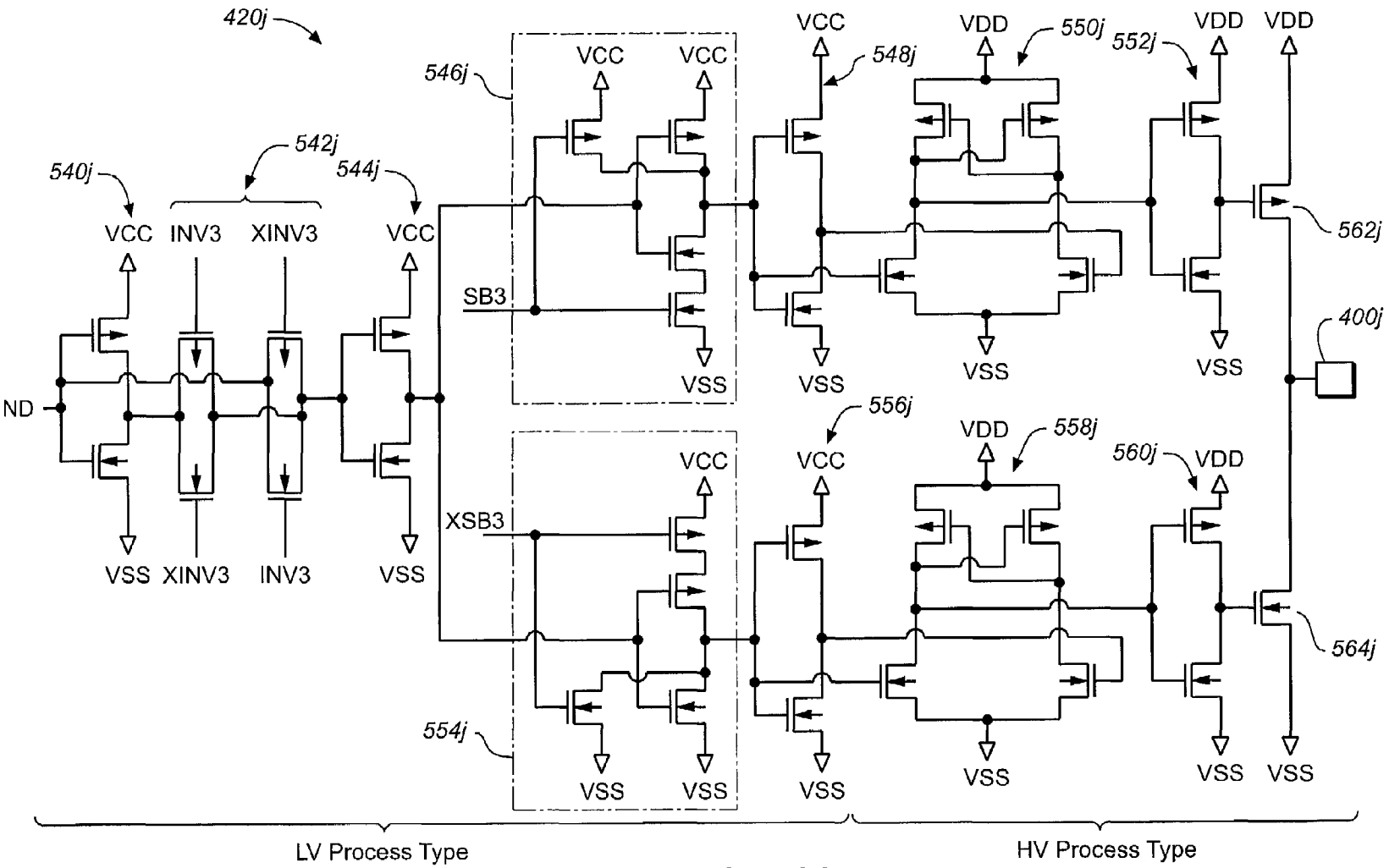
FIG. 11 shows an example of the circuit configuration of an LV-HV output buffer in a preferred embodiment of the invention.

FIG. 11 shows an example of the circuit configuration of the LV-HV output buffer 420*j*.

The LV-HV output buffer 420*j* has inverter circuits 540*j* and 544*j*, multiplexor circuit 542*j*, NAND gate 546*j*, inverter circuits 548*j* and 552*j*, level shifter 550*j*, NOR gate 554*j*, inverter circuits 556*j* and 560*j*, and level shifter 558*j*. Multiplexor circuit 542*j* in conjunction with inverter circuit 540*j* produce an XOR function with signals ND and INV3 as inputs.

This LV-HV output buffer 420*j* has p-type transistor 562*j* and n-type transistor 564*j* connected between HV supply voltage VDD and ground level VSS for high impedance control of output to I/O pad 400*j*.

Inverter circuits 540*j*, 544*j*, 548*j*, and 556*j*, multiplexor circuit 542*j*, NOR gate 546*j* and NAND gate 554*j* are comprised of LV transistors. The level shifters 550*j* and 558*j*, inverter circuits 552*j* and 560*j*, p-type transistor 562*j*, and n-type transistor 564*j* are comprised of HV transistors.

The input node ND is connected to the input node of inverter 540*j*.

The input node and output node of inverter circuit 540*j* are connected to multiplexor circuit 542*j*. Multiplexor circuit 542*j* together with inverter 540*j* achieve an XOR function and obtain the exclusive OR of the logic levels of inversion control signal INV3 and input node ND, and supply the result to the input node of inverter circuit 544*j*.

The output node of inverter circuit 544*j* is connected to NOR gate 546*j* and to NAND gate 554*j*.

NOR gate 554*j* obtains the inverse OR of the logic level of control signal SB3 and the logic level of the output node of inverter circuit 544*j*, and supplies the result to the input node of inverter circuit 548*j*.

NAND gate 546*j* obtains the inverse AND of the logic level of control signal SB3 and the output node of inverter circuit 544*j*, and supplies the result to the input node of inverter circuit 556*j*.

Level shifter 550*j* outputs an HV level voltage (i.e. VDD) or ground potential (i.e. VSS) as determined by the logic level of the output of NAND gate 546*j* (i.e. the input and output nodes of inverter circuit 548*j*), and supplies the result to the input node of inverter 552*j*, which is comprised of HV transistors. The output node of inverter circuit 552*j* is connected to the gate of p-type transistor 562*j*.

Level shifter 558*j* outputs an HV voltage (i.e. VDD) or ground potential (i.e. VSS) as determined by the logic level of the output of NOR gate 554*j* (i.e. the input and output nodes of inverter circuit 556*j*), and supplies the result to the input node of inverter circuit 560*j*, which is comprised of HV transistors. The output node of inverter circuit 560*j* is connected to the gate of n-type transistor 564*j*.

The LV-HV output buffer 420*j* can thus also freely invert the logic level of the input node ND based on inversion control signal INV3. The gate control signal generated from the output node and control signal SB3 is also converted to an HV level voltage by level shifter 550*j* and level shifter 558*j* for controlling p-type transistor 562*j* and n-type transistor 564*j*.

Because logic level inversion can be freely controlled using the inversion control signal INV3, design changes due to a change in external interface specifications can be avoided and development time can be shortened. It is also possible to provide an output buffer circuit for shifting LV level voltages to HV level voltages and high impedance controlling the output.

Figure 12:
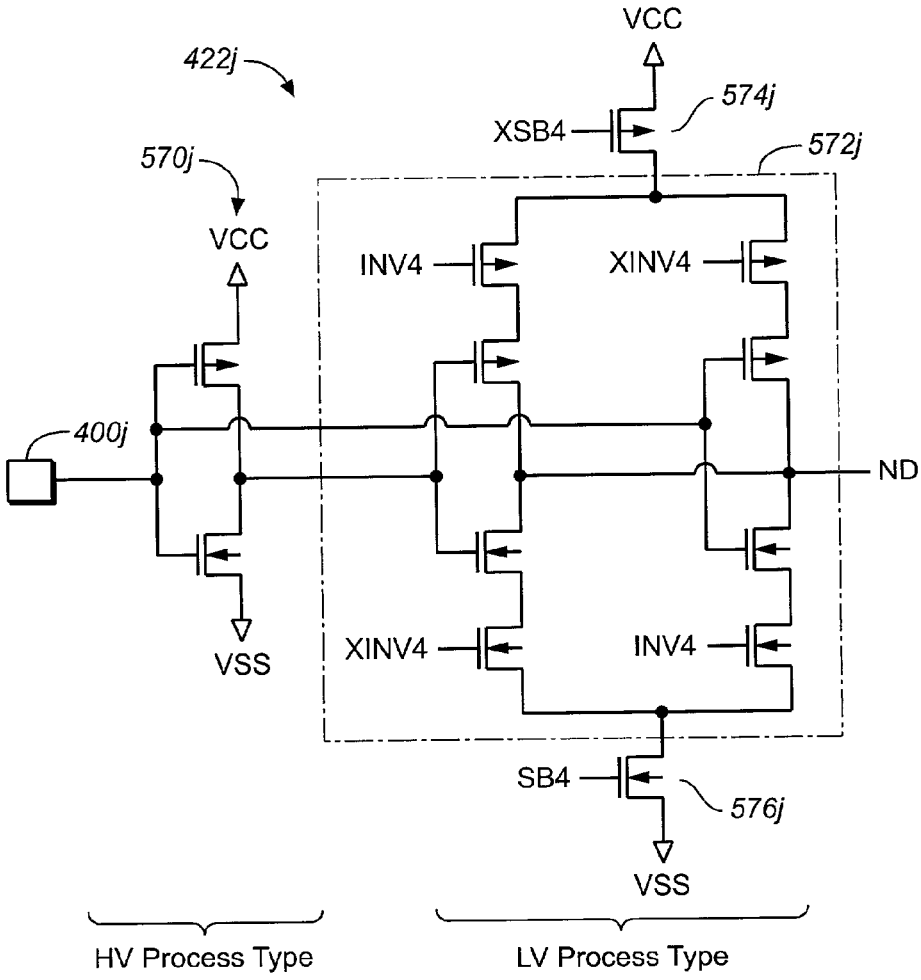
FIG. 12 shows an example of the circuit configuration of an HV-LV input buffer in a preferred embodiment of the invention.

FIG. 12 shows an example of the circuit configuration of the HV-LV input buffer 422*j*.

The HV-LV input buffer 422*j* comprises an inverter circuit 570*j* and an multiplexor 572*j*. Inverter circuit 570*j* and multiplexor 572*j* together functions as an XOR gate.

The inverter circuit 570*j* is comprised of HV transistors, and the LV supply voltage VCC is supplied to the inverter circuit 570*j* as the supply voltage level.

The I/O pad 400*j* is connected to the input node of inverter circuit 570*j*. As a result, when an LV signal voltage is supplied to the I/O pad 400*j*, inverter circuit 570*j* detects the signal and passes the inverted signal to its output node.

The input and output nodes of the inverter circuit 570*j* are connected to multiplexor 572*j*. The combination of inverter circuit 570*j* and multiplexor 572*j* obtain the exclusive OR logic combination of the inversion control signal INV4 and the logic level of I/O pad 400*j*, and the result becomes the logic level of node ND.

Multiplexor 572*j* is connected to LV supply voltage VCC through p-type transistor 574*j* and to ground level VSS through n-type transistor 576*j*. Inverted control signal XSB4 is supplied to the gate of p-type transistor 574*j* and control signal SB4 is supplied to the gate of n-type transistor 576*j*.

Therefore, when HV-LV input buffer 422*j* is selected, the result of the exclusive OR operation is output on node ND, and when not selected node ND goes to a high impedance state.

The HV-LV input buffer 422*j* thus receives signals from I/O pad 400*j* through HV inverter circuit 570*j* connected to LV supply voltage VCC, and can freely invert the logic level by means of multiplexor 572*j*. As a result, reliability is not impaired even when an HV voltage is mistakenly applied to I/O pad 400*j*, and an LV level voltage can be supplied to node ND. Furthermore, because the logic level can be freely inverted as controlled by inversion control signalINV4, design changes due to a change in external interface specifications can be avoided and development time can be shortened.

Control circuit 440*j* (FIG. 8), which separately controls each of the buffers, generates control signals SB1 to SB4, selection signals SEL1 to SEL16, and switching control signal SA.

Figure 13:
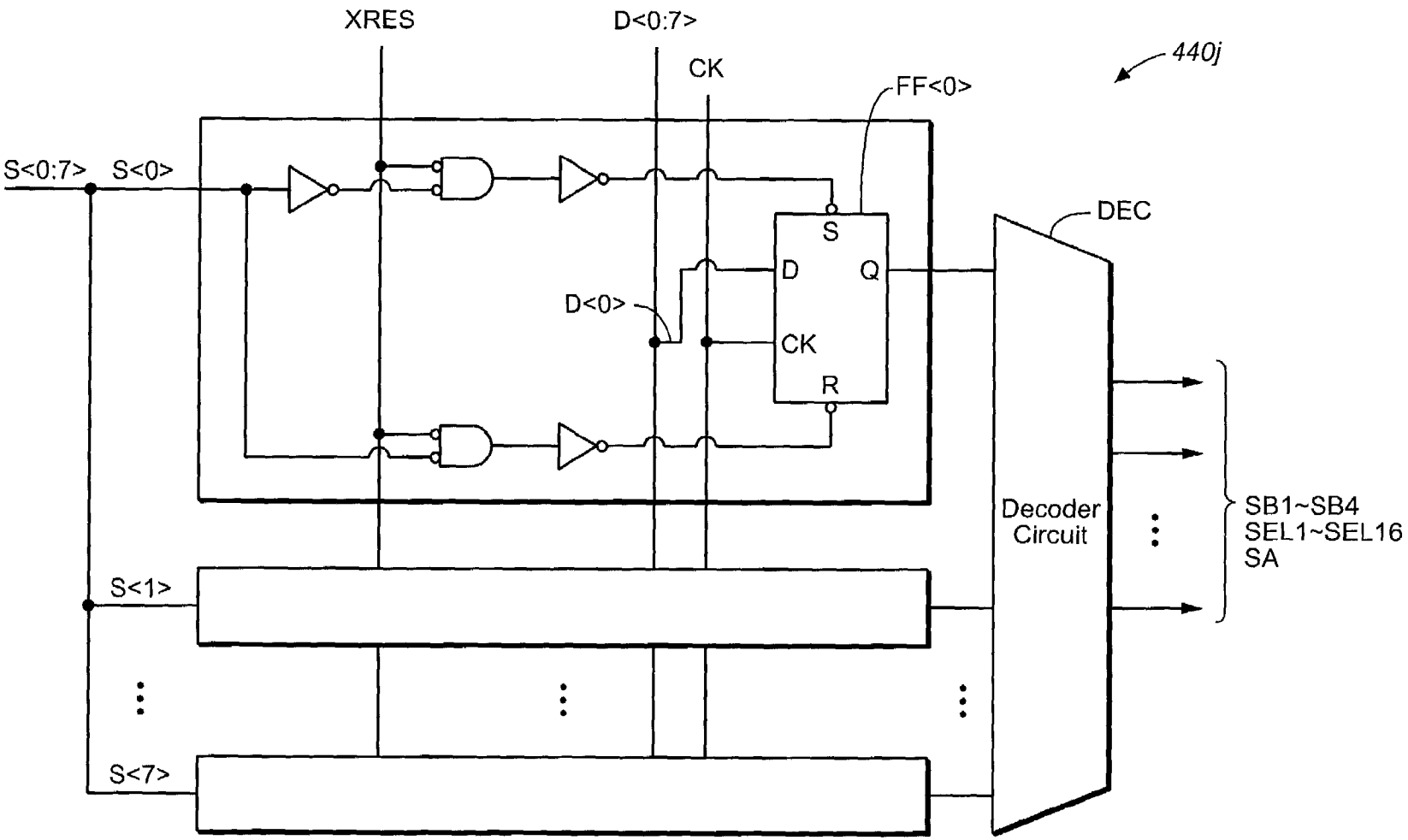
FIG. 13 shows an example of the circuit configuration of the control circuit in a preferred embodiment of the invention.

FIG. 13 shows an example of the circuit configuration of control circuit 440*j*.

This control circuit 440*j* generates control signals SB1 to SB4, selection signals SEL1 to SEL16, and switching control signal SA by setting specific command registers by means of LCD controller 60.

The inputs to decoder DEC from flip-flops FF<0:7> are synchronized to clock signal CK. In accordance with clock signal CK, flip-flops FF<0:7> latch address decode pulses from corresponding data bus lines D0 to D7, which are generated when a particular command register is accessed by the LCD controller 60. That is, data bus lines D7 to D0 each carry one bit of data representative of a corresponding address decode pulse, and the data bit is stored in corresponding flip-flops FF<0:7>. The flip-flops FF<0:7> are set or reset by the logical combination of default data S7 to S0 and inversion reset signal XRES. For example, if XRES is at a logic low, then a flip-flop (i.e. FF<0>) will be initialized (i.e. will be set) if its corresponding default data (S0) is at a logic high and will be reset if its corresponding default data (S0) is at a logic low, Additionally, default data S7 to S0 can be fixed to either the supply voltage or to ground level by appropriate blowing of Al fuses (or other post-fabrication shorting method, such as the using of a laser to cut metal traces). The default state can thus be permanently set The data stored in each of the flip-flops is thus decoded by decoder circuit DEC to output control signals SB1 to SB4. The control circuit 440*j* thus comprised can select one selector line from among the plurality of selector lines 430 by means of selector circuit 424*j* (FIG. 7), and provides separate control for the four buffer circuits.

It should be noted that the output load of the buffers can be reduced by electrically disconnecting the buffers and selector lines by applying an appropriate switching control signal SA.

Furthermore, inversion control signals INV1 to INV4 can be likewise generated.

4. LCD Apparatus Applying a Signal Driver According to the Present Invention.

Figure 14:
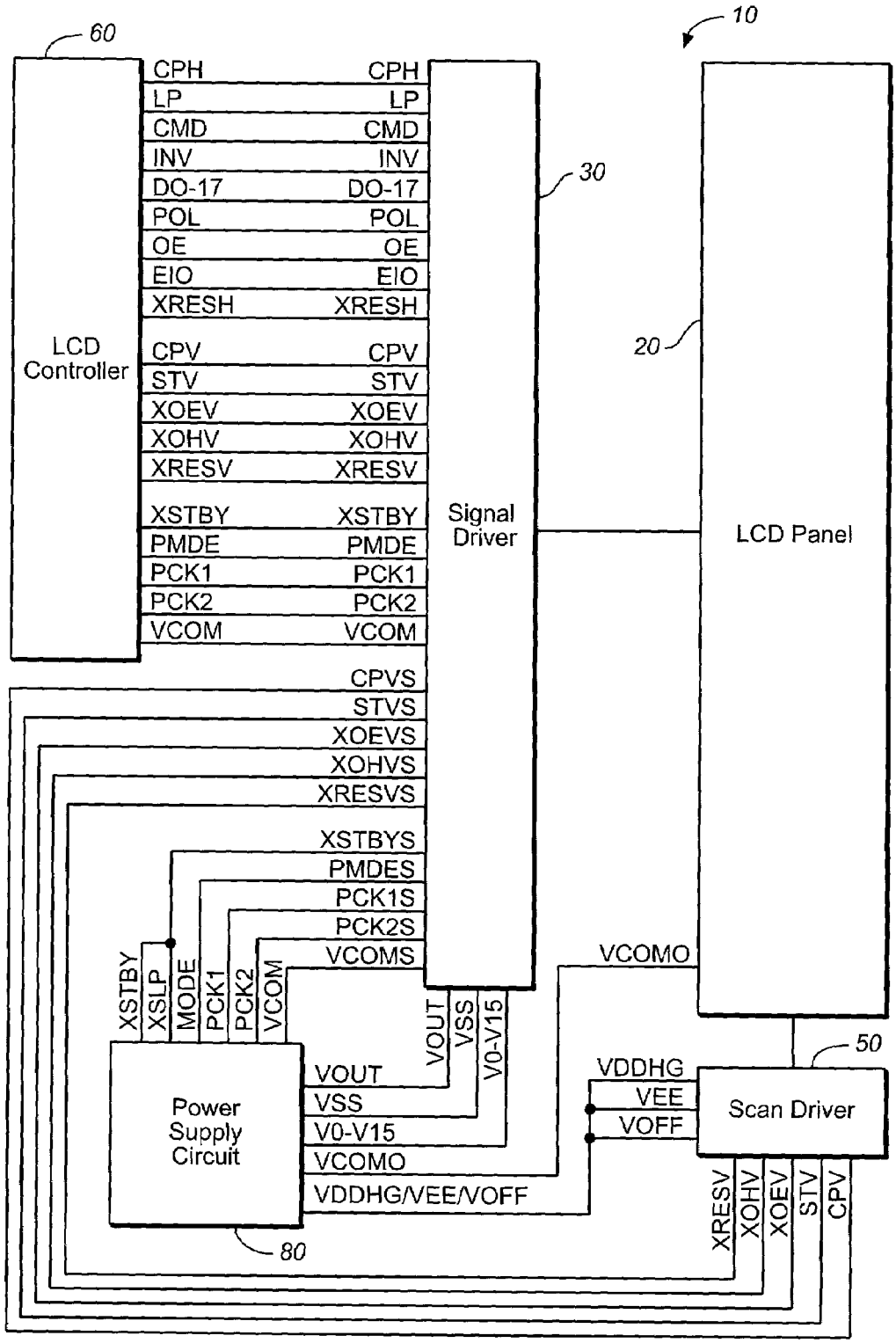
FIG. 14 shows the basic configuration of a display apparatus applying a signal driver according to the present invention.

FIG. 14 shows the basic configuration of a liquid crystal apparatus 10 applying a signal driver according to the present invention.

It should be noted that like parts in FIG. 14 and FIG. 4 are identified by like reference numerals, and further description thereof is omitted below.

The LCD controller 60 supplies clock signal CPH, latch pulse LP as a horizontal synchronization signal, command signal CMD specifying a particular command, inverse signal INV of a signal, data D0 to D17 representing image data or command data, polarization inversion signal POL indicating the polarity inversion drive timing, output enable signal OE, enable I/O signal EIO, and inversion reset signal XRESH to the signal driver 30 for signal drive control.

The LCD controller 60 also supplies clock signal CPV, start signal STV as a vertical synchronization signal, inverse output enable signal XOEV, output control signal XOHV for controlling output of all scan lines, and inversion reset signal XRESV to the scan driver 50 for scan drive control. In this embodiment of the invention control signals to be supplied from LCD controller 60 to the scan driver 50 pass through signal driver 30 having I/O circuits as described above for level shifting before being supplied to the scan driver 50.

The LCD controller 60 also supplies standby control signal XSTBY, step-up mode setting signal PMDE, primary and secondary step-up clocks PCK1 and PCK2, and opposing electrode voltage polarity inversion signal VCOM to the power supply circuit 80 for power supply control. In this embodiment of the invention control signals to be supplied from LCD controller 60 to the power supply circuit 80 pass through signal driver 30 having I/O circuits as described above for level shifting before being supplied to the power supply circuit 80.

It is therefore not necessary to provide an HV interface circuit in the LCD controller 60, which has a relatively complex circuit configuration, and signals can be shifted and passed by the signal driver 30, which is manufactured in a medium voltage process and does not require shrinking. The LCD controller 60 therefore has wide applicability and significant cost reductions can be achieved by applying a smaller design rule to reduce chip size.

5. Other

The present embodiment has been described using by way of example a liquid crystal display apparatus with an LCD panel using TFT liquid crystals, but the invention shall not be so limited. For example, the invention can also be applied to a signal driver and scan driver for driving an organic EL panel display using organic EL devices disposed at pixel locations defined by the signal lines and scan lines.

Figure 15:
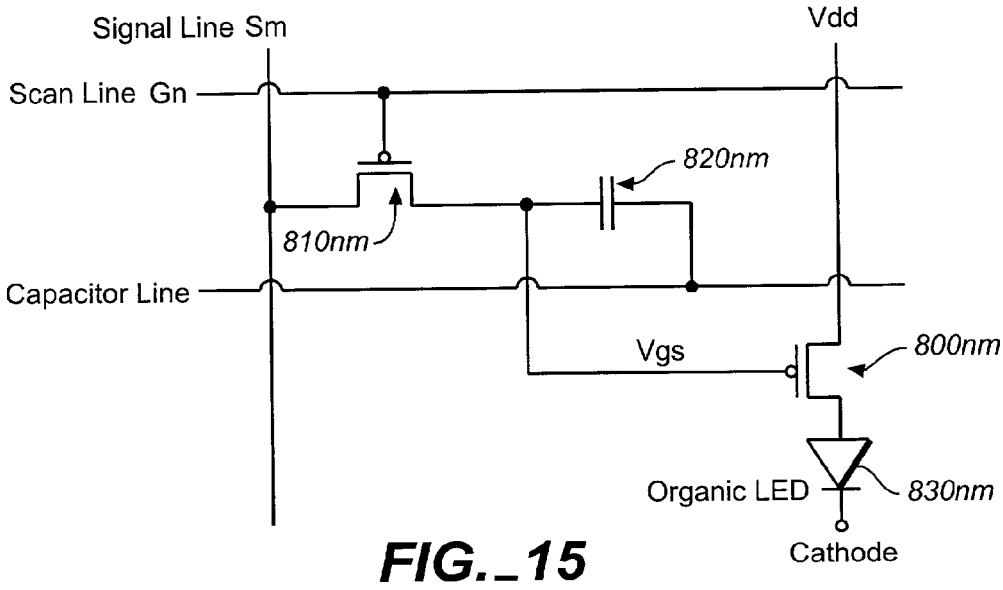
FIG. 15 is a circuit diagram showing one example of a 2-transistor pixel circuit in an organic EL panel.

FIG. 15 shows an example of a 2-transistor pixel circuit in an organic EL panel display controlled by a signal driver and scan driver as described above according to the present invention.

This organic EL panel has a drive TFT 800*nm*, switch TFT 810*nm*, storage capacitor 820*nm*, and organic LED 830*nm* at the intersection of each signal line Sm and scan line Gn. The drive TFT 800*nm* is a p-type transistor.

The drive TFT 800*nm* and organic LED 830*nm* are connected in series to the power supply line.

The switch TFT 810*nm* is inserted between the gate of drive TFT 800*nm* and signal line Sm. The gate of switch TFT 810*nm* is connected to scan line Gn.

The storage capacitor 820*nm* is inserted between the gate of drive TFT 800*nm* and the capacitor line.

When scan line Gn is driven and switch TFT 810*nm* turns on in this organic EL device, the voltage of signal line Sm is transferred to storage capacitor 820*nm* and applied to the gate of drive TFT 800*nm*. The gate voltage Vgs of drive TFT 800*nm* is determined by the voltage of signal line Sm, and controls current flow through drive TFT 800*nm*. Because the drive TFT 800*nm* and organic LED 830*nm* are connected in series, current flow through drive TFT 800*nm* flows directly to organic LED 830*nm*.

Therefore, by holding gate voltage Vgs set to the voltage of the signal line Sm in storage capacitor 820*nm*, a pixel that continues emitting throughout one frame period, for example, can be achieved by supplying a current corresponding to the gate voltage Vgs to organic LED 830*nm*.

Figure 16A:
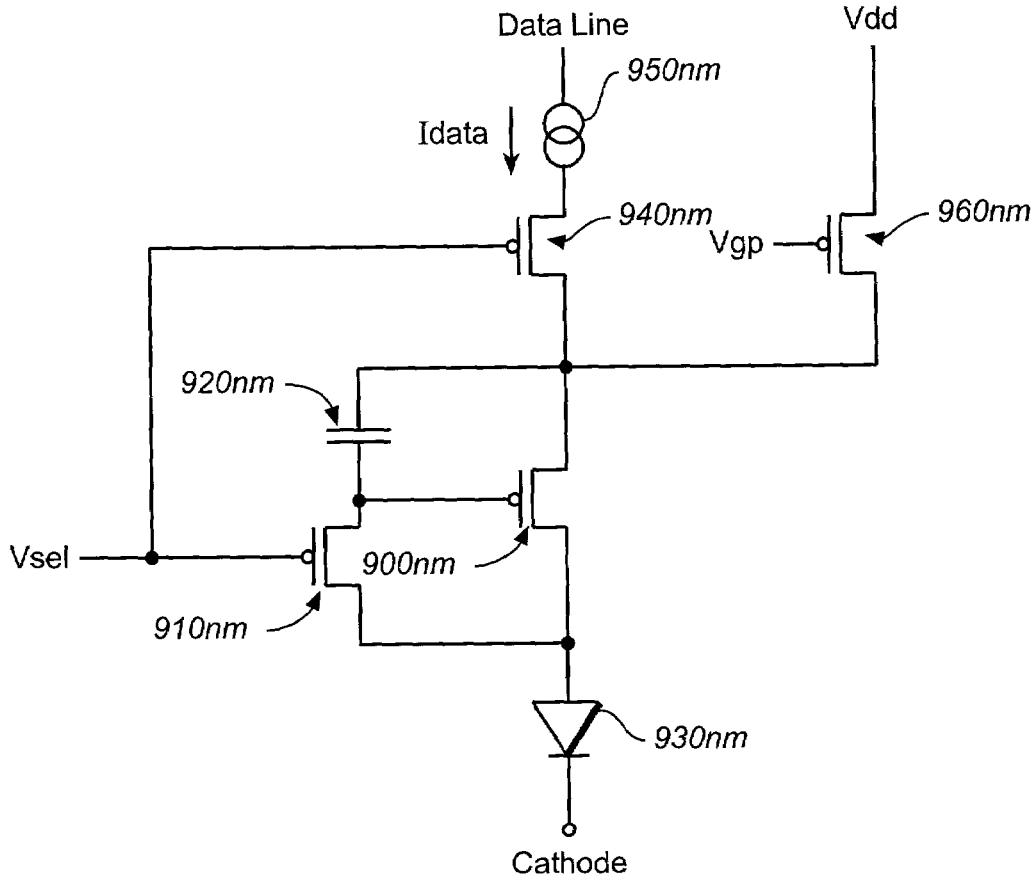
FIG. 16A is a circuit diagram showing one example of a 4-transistor pixel circuit in an organic EL panel.
Figure 16B:
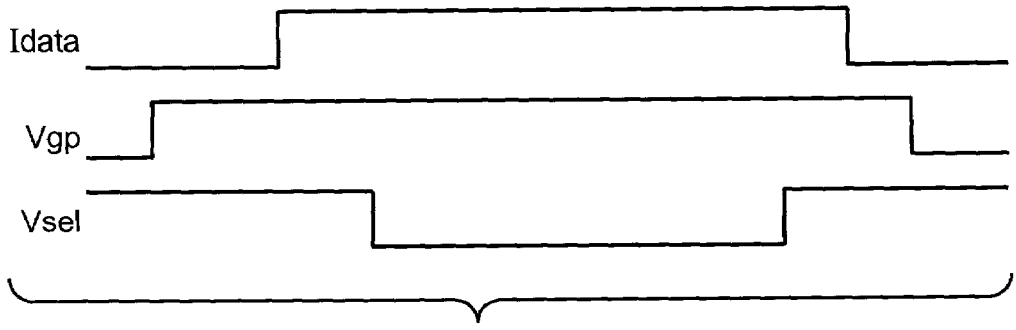
FIG. 16B is a timing chart showing an example of the display control timing of the 4-transistor pixel circuit.

FIG. 16A shows an example of a 4-transistor pixel circuit in an organic EL panel driven by a signal driver and scan driver as described above. FIG. 16B shows an example of the display control timing for this pixel circuit.

In this case the organic EL panel has a drive TFT 900*nm*, switch TFT 910*nm*, storage capacitor 920*nm*, and organic LED 930*nm*.

This circuit differs from the 2-transistor pixel circuit shown in FIG. 15 in that instead of a constant voltage, a constant current Idata is supplied to the pixel from constant current source 950*nm* through p-type TFT 940*nm*, which functions as a switching element. Additionally, storage capacitor 920*nm* and drive TFT 900*nm* are connected to the power supply line through p-type TFT 960*nm*, which functions as a switching element.

With this organic EL device p-type TFT 960*nm* is first turned off by gate voltage Vgp to interrupt the power supply line, and p-type TFT 940*nm* and switch TFT 910*nm* are turned on by gate voltage Vsel to supply constant current Idata from 950*nm* to the drive TFT 900*nm*.

A voltage corresponding to constant current Idata is held in storage capacitor 920*nm* until current flow to the drive TFT 900*nm* stabilizes.

Gate voltage Vsel is then applied to turn off p-type TFT 940*nm* and switch TFT 910*nm*, and gate voltage Vgp is applied to turn on p-type TFT 960*nm*, thereby electrically connecting the power supply line, drive TFT 900*nm*, and organic LED 930*nm*. Current equal to or greater than constant current Idata is thus supplied to the organic LED 930*nm* at this time based on the voltage held in storage capacitor 920*nm*.

This type of organic EL device can also be configured with the scan lines as gate voltage Vsel and the signal lines as the data lines.

The configuration of the organic LED is not limited and can be configured with the light-emitting layer over the transparent anode (ITO) and a metal cathode on top, or with the light-emitting layer, light-transmitting cathode, and transparent seal on top of the metal anode.

The display controller for driving an organic EL panel can thus be scaled down by configuring the signal driver for display driving an organic EL panel containing such organic EL devices as described above.

It will be apparent to one with ordinary skill in the related art that the present invention shall not be limited to the embodiments described above and can be varied in many ways without departing from the scope of the accompanying claims. For example, the invention can also be applied to a plasma display device.

Furthermore, a signal driver has been described above as the line driver circuit by way of example, but the invention shall also not be so limited.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A line driver circuit configured to drive a first line of an electro-optic device having a pixel identified by the first line and a second line intersecting the first line, comprising:

a plurality of selector lines; and a plurality of I/O circuits each of which is electrically coupled to the plurality of selector lines;

each of the plurality of I/O circuits including:

an I/O terminal that is coupled to either a second line driver circuit for driving the second line or a display controller for controlling display of the electro-optic device;

a first input buffer circuit that receives a first-voltage-level voltage from the I/O terminal and that outputs first-voltage-level voltage to a first selector line of the plurality of selector lines;

a second input buffer circuit that receives a second-voltage-level voltage from the I/O terminal and that converts to the first-voltage-level voltage, the second input buffer circuit outputs the converted first-voltage-level voltage to the first selector line;

a first output buffer circuit that receives the first-voltage-level voltage from the first selector line and that outputs the first-voltage-level voltage to the I/O terminal;

a second output buffer circuit that receives the first-voltage-level voltage from the first selector line and that converts to the second-voltage-level voltage, the second output buffer circuit outputs the converted voltage to the I/O terminal; and a plurality of selector switches that electrically couple the first selector line to one of the first input buffer circuit, the second input buffer circuit, the first output buffer circuit, or the second output buffer circuit; and each one of the plurality of I/O circuit exclusively placing only one of the first input buffer circuit, the second input buffer circuit, the first output buffer circuit, or the second output buffer circuit in an operating mode while placing the other of the first input buffer circuit, the second input buffer circuit, the first output buffer circuit, and the second output buffer circuit in a non-operating mode.

2. A line driver circuit as described in claim 1, wherein said first line is a signal line for supplying a voltage dependent on image data.

3. A line driver circuit configured to drive first line of an electro-optic device having a pixel identified by the first line and a second line intersecting the first line, comprising:

a plurality of selector lines; and a plurality of I/O circuits each of which is electrically coupled to the plurality of selector lines;

each of the plurality of I/O circuits including:

an I/O terminal that is coupled either to a power supply circuit for supplying power to the line driver or to a display controller for controlling display of the electro-optic device;

a first input buffer circuit that receives a first-voltage-level voltage from the I/O terminal and that outputs first-voltage-level voltage to a first selector line of the plurality of selector lines;

a second input buffer circuit that receives a second-voltage-level voltage from the I/O terminal and that converts to the first-voltage-level voltage, the second input buffer circuit outputs the converted first-voltage-level voltage to the first selector line;

a first output buffer circuit that receives the first-voltage-level voltage from the first selector line and that outputs the first-voltage-level voltage to the I/O terminal;

a second output buffer circuit that receives the first-voltage-level voltage from the first selector line and that converts to the second-voltage-level voltage, the second output buffer circuit outputs the converted voltage to the I/O terminal; and a plurality of selector switches that electrically couple the first selector line to one of the first input buffer circuit, the second input buffer circuit, the first output buffer circuit, or the second output buffer circuit; and each one of the plurality of I/O circuit exclusively placing only one of the first input buffer circuit, the second input buffer circuit, the first output buffer circuit, and the second output buffer circuit in an operating mode while placing the other of the first input buffer circuit, the second input buffer circuit, the first output buffer circuit, and the second output buffer circuit in a non-operating mode.

4. An electro-optic device comprising:

pixels identified by a plurality of first lines and a plurality of intersecting second lines;

a line driver circuit as described in claim 1; and a second line driver circuit for driving said second lines.

5. A display apparatus comprising:

an electro-optic device having pixels identified by a plurality of first lines and a plurality of intersecting second lines;

a line driver circuit as described claim 1; and a second line driver circuit for driving said second lines.

6. A line driver circuit as described in claim 1, wherein said second second-voltage-level voltage is higher than said first-voltage-level voltage.

7. A line driver circuit as described in claim 1, wherein said line driver circuit lacks an internal power supply circuit.

8. A line driver circuit as described in claim 1, further comprising a signal driver circuit including a plurality of input/output buffer networks, each input/output buffer network having:

an input/output node coupled to one of said input terminal or said output terminal;

wherein:

said first input buffer circuit having its input coupled to said input/output node and its output coupled to an intermediary node;

said second input buffer circuit having its input coupled to said input/output node and its output coupled to said intermediary node;

said first output buffer circuit having its input coupled to said intermediary node and its output coupled to said input/output node;

said second output buffer circuit having its input coupled to said intermediary node and its output coupled to said input/output node.

9. A line driver circuit as described in claim 8, wherein said signal driver circuit further includes:

a first selector switch selecting said first selector line from among said plurality of selector lines, and for selectively coupling the intermediary node of a first of said plurality of input/output buffer networks to said first selector line; and a second selector switch for selectively coupling the intermediary node of a second of said plurality of input/output buffer networks to said first selector line.

* * * * *